US008381655B2

(12) United States Patent
Swingley et al.

(10) Patent No.: US 8,381,655 B2
(45) Date of Patent: Feb. 26, 2013

(54) ALUMINUM CARTRIDGE CASING FOR RIFLES

(75) Inventors: Douglas Swingley, Santa Clarita, CA (US); Robert Wayne Spears, Ketchikan, KS (US); Scott Miller, Lake View Terrace, CA (US); Mehroujan Shirvanian, Glendale, CA (US)

(73) Assignee: Spears Manufacturing Co., Sylmar, CA (US)

( * ) Notice: Subject to any disclaimer, the term of this patent is extended or adjusted under 35 U.S.C. 154(b) by 0 days.

(21) Appl. No.: 13/432,118

(22) Filed: Mar. 28, 2012

(65) Prior Publication Data

US 2012/0285345 A1 Nov. 15, 2012

Related U.S. Application Data

(60) Provisional application No. 61/472,785, filed on Apr. 7, 2011.

(51) Int. Cl.
*F42B 5/28* (2006.01)
*B23P 15/22* (2006.01)

(52) U.S. Cl. ..... 102/464; 86/19.5; 86/19.6

(58) Field of Classification Search ..... 86/19.5, 86/19.6, 19.7, 1.1; 102/464
See application file for complete search history.

(56) References Cited

PUBLICATIONS

Pages from Internet Web site article, www.g2mil.com/aluminum-ammo.htm, entitled "Aluminum Cased Ammo," publication date 2003.

Pages from Internet Web site article, http://en.wikipedia.org/wiki/Cartridge_(firearms), entitled "Cartridge (firearms)," publication date unknown.

*Primary Examiner* — James Bergin
(74) *Attorney, Agent, or Firm* — Sheldon Mak & Anderson

(57) ABSTRACT

A cartridge casing for rifles is made from a high strength aluminum alloy. A method for making such cartridge casing includes the steps of (a) forming a cylindrical blank from an aluminum alloy having a tensile strength greater than 80,000 psi, and (b) rotating the blank at a rate greater than 500 rpm and forcing the blank into a die, the die having a bore with progressively reduced interior diameters which are less than the external diameter of the blank. In the method, the forcing of the blank into the die results in the finished cartridge casing having a distal end with an external diameter which is less than the external diameter of its proximal end.

3 Claims, 1 Drawing Sheet

ALUMINUM CARTRIDGE CASING FOR RIFLES

CROSS-REFERENCE TO RELATED APPLICATIONS

This application claims priority from Provisional Patent Application Ser. No. 61/472,785, filed Apr. 7, 2012, entitled ALUMINUM CARTRIDGE CASING FOR RIFLES, which is incorporated in its entirety herein.

BACKGROUND OF THE INVENTION

Fire arm cartridge casings are typically made from brass. There are a few notable exceptions. Shotgun cartridge casings today are made from a combination of brass and plastic. In the past, shotgun cartridge casings having been made from brass and paper, brass and plastic, all brass and all plastic. Also, some pistol and rifle cartridges have been made from steel.

There are many reasons why cartridge casings made from aluminum would be highly desirable. Aluminum casing weights would be typically ⅓ the weight of either a steel or brass casing. For example four fully loaded aluminum cased cartridges weigh the same as three with brass or steel casings. This has significant impact on the battlefield where weight is critical—for either allowing aircraft to carry more ammunition, fuel or cargo, or relieving the load on a foot soldier, allowing him or her to go further faster, or carry more ammunition.

Another significant advantage aluminum has over brass is material pricing. Brass prices are closely coupled to copper prices which are typically much higher than aluminum.

Aluminum is also less harmful to the environment than the copper and lead in brass. Aluminum also has an advantage over steel in corrosion resistance.

While there are some pistol cartridge casings that are made from aluminum, as well as some cartridge casings for large projectiles (such as grenade launchers) made from aluminum, there are almost no aluminum cartridge casings for rifles.

There are several reasons why cartridge casings made for rifles have hither to not been made from aluminum.

1) Chamber pressures for different firearms are typically as follows: Rifle 60,000 psi, Pistol 40,000 psi, Shotgun 10,000 psi, Grenade Launchers 3000 psi. As the chamber pressure increases, stress on the casing increases. Thus, with higher pressures, damage from leaking propellant gasses can cause significantly more damage. Only aluminum alloys with exception tensile strength can safely withstand the chamber pressures of most rifle cartridges.
2) Aluminum has the capability of being explosive and in rapid high temperature ignition "explosive" environment, can become molten, and rapidly decompose (explosive plasma). Leakage of propellant past the primer in cartridge casings can cause the aluminum to melt and explode damaging the firearm and can cause injury. The explosive plasma nature of aluminum can cause any gas leak to have the potential to damage the firearm and cause significant injury.
3) Most rifle cartridge casings are "necked" meaning the end that secures the bullet is smaller than the end that holds the powder charge and primer. Such "necking" of rifles casings is highly desired to provide sufficient room for the required propellant without having to construct the cartridge with excessive length. Necking forces the casing to be made in one of two ways. Either the inside of the casing is machined away with a tool that has to be small enough to pass through the neck, then cut the inside diameter larger—a tedious time-consuming process referred to as "undercutting." Alternatively, the neck may be somehow formed by other mechanical means. However, the formability of high-strength aluminum alloys is quite poor, making undercutting and other mechanical means difficult and expensive procedures.

Accordingly, there is a need for an aluminum rifle cartridge casing which avoids the aforementioned problems in the prior art.

SUMMARY OF THE INVENTION

The invention satisfies this need. In one sense, the invention is a necked cartridge casing for rifles made from a high strength aluminum alloy. In another sense, the invention is a method for making such cartridge casing. The method comprises the steps of (a) forming a cylindrical blank from an aluminum alloy having a tensile strength greater than 80,000 psi, the blank having a proximal end, an open distal end, a circular cross-section, an external diameter and a longitudinal axis, and (b) rotating the blank about its longitudinal axis at a rate greater than 500 rpm and forcing the distal end of the blank into at least one die, the die having a bore with an opening diameter capable of accepting the distal end of the blank, the bore further having progressively reduced interior diameters which are less than the external diameter of the distal end of the blank. In the invention, the forcing of the distal end of the blank into the at least one die in step (b) results in the finished cartridge casing having a distal end with an external diameter which is less than the external diameter of its proximal end.

DRAWINGS

These and other features, aspects and advantages of the present invention will become better understood with reference to the following description, appended claims and accompanying drawings where:

DETAILED DESCRIPTION OF THE INVENTION

Figure 1:
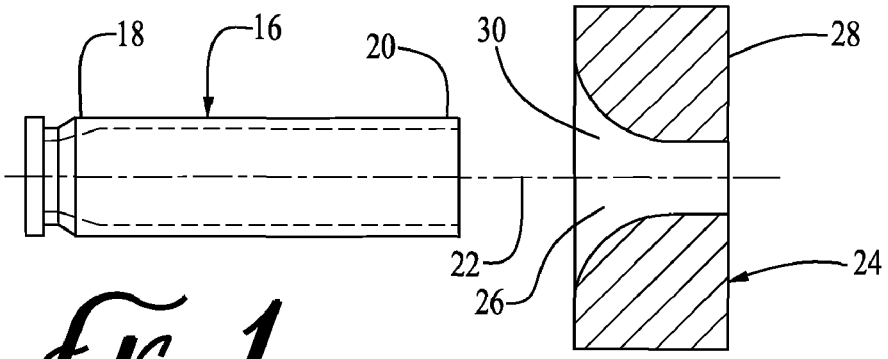
FIG. 1 is a cross-sectional schematic view illustrating the initial steps of a method having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

In one sense, the invention is a cartridge casing 10 for rifles made from a high strength aluminum alloy. The cartridge casing 10 has a proximal end 12 and a distal end 14, both of which have circular cross-sections. The distal end 14 has a cross-sectional external diameter less than 80% of the cross-sectional external diameter of the proximal end 12.

As used in this application, a cartridge casing for rifles is a cartridge casing suitable for a cartridge with a maximum average pressure under ANSI/SAAMI standards of 50,000 psi or greater.

By "high strength aluminum alloy," it is meant an aluminum alloy having a tensile strength greater than 80,000 psi. One example of a high strength aluminum alloy is Kaiser Aluminum Alloy 7068, having a tensile strength of about 90,000 psi at 70° F.

In another sense, the invention is also a method for making the cartridge casing 10 of the invention. The method comprises the steps of (a) forming a cylindrical blank 16 from an aluminum alloy having a tensile strength greater than 80,000 psi, the blank 16 having a proximal end 18, an open distal end 20, an external diameter and a longitudinal axis 22, and (b) rotating the blank 16 about its longitudinal axis 22 at a rate greater than 500 rpm, preferably greater than 700 rpm, and forcing the distal end 20 of the blank 16 into at least one die 24, the die having a bore 26 with an opening diameter capable of accepting the distal end 20 of the blank 16. In the method, the distal end 14 of the finished cartridge casing 10 has progressively reduced interior diameters which are less than the external diameter of the distal end 20 of the blank 16.

By the method of the invention, the forcing of the distal end 20 of the blank 16 into the at least one die 24 causes the blank 16 to "neck down," that is, to have a distal end 20 with an external diameter which is less than 80% of the external diameter of the proximal end 18 of the blank 16.

The drawings illustrate one method of the invention directed to the creation of a 5.56×45 mm rifle cartridge casing 10.

Figure 2:
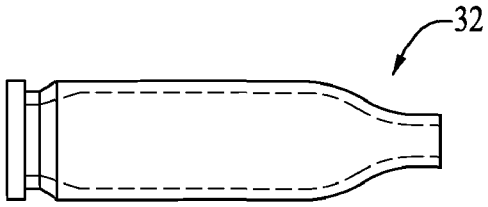
FIG. 2 is a cross-sectional schematic view of a rough part produced by the method steps illustrated in FIG. 1.

In FIG. 1, a cylindrical blank 16 is made from a high strength aluminum alloy with a wall thickness of about 0.020 inches and an outside diameter of about 0.375 inches. The blank 16 is rotated at about 750 rpm and forced into a roughing die 28 at an axial velocity of about 0.005 inches per revolution. The roughing die 28 has an opening 30 with rounded sides and a diameter greater than 0.375 inches, the external diameter of the blank 16. The resulting rough part 32 is illustrated in FIG. 2.

Figure 3:
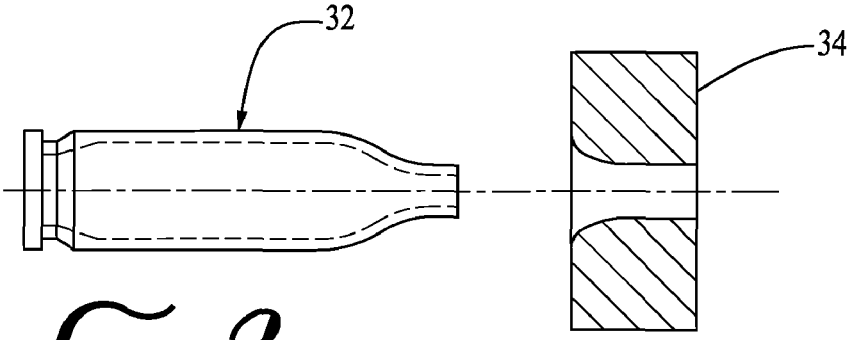
FIG. 3 is a cross-sectional schematic view illustrating further steps in the method illustrated in FIG. 1.

FIG. 3 illustrates the further modification of the rough part 32 by rotating the rough part 32 at about 750 rpm into a finish die 34 at an axial velocity of about 0.005 inches per revolution. The smallest diameter of the finish die 34 is about 0.240 inches.

Figure 4:
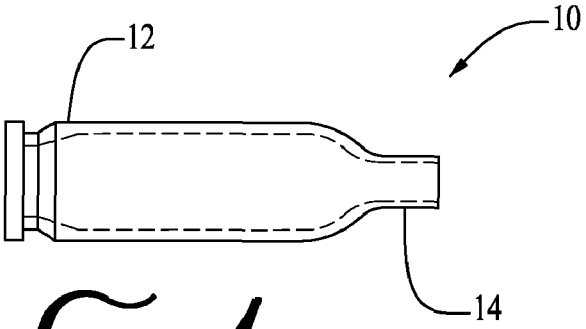
FIG. 4 is a finished cartridge derived from the method steps illustrated in FIG. 3.

A finished cartridge casing 10 is illustrated in FIG. 4. The finished cartridge casing 10 illustrated in FIG. 4 is the result of the method steps illustrated in FIG. 3 followed by a reaming of the distal end of the rough part 32 produced in the steps of FIG. 3 to yield a nose wall thickness of about 0.010 inches.

The finished cartridge 10 meets the standards set forth by the Sporting Arms and Ammunition Manufacturers Institute (SAAMI) and the American National Standards Institute (ANSI).

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for forming a rifle cartridge casing comprising the steps of:

(a) forming a cylindrical blank from an aluminum alloy having a tensile strength greater than 80,000 psi, the blank having a proximal end, an open distal end, a circular cross-section, an external diameter and a longitudinal axis; and (b) rotating the blank about its longitudinal axis at a rate greater than 500 rpm and forcing the distal end of the blank into at least one die, the die having a bore with an opening diameter capable of accepting the distal end of the blank, the bore further having progressively reduced interior diameters which are less than the external diameter of the distal end of the blank;

wherein the forcing of the distal end of the blank into the at least one die in step (b) results in the finished cartridge casing having a distal end with an external diameter which is less than the external diameter of its proximal end.

2. The method of claim 1 wherein the distal end of the finished cartridge casing has a cross-sectional external diameter less than 80% of the cross-sectional external diameter of the proximal end of the finished cartridge casing.

3. The method of claim 1 wherein the at least one dye comprises a rough dye and a finish dye.

* * * * *

UNITED STATES PATENT AND TRADEMARK OFFICE

CERTIFICATE OF CORRECTION

PATENT NO. : 8,381,655 B2
APPLICATION NO. : 13/432118
DATED : February 26, 2013
INVENTOR(S) : Douglas Swingley et al.

It is certified that error appears in the above-identified patent and that said Letters Patent is hereby corrected as shown below:

ON THE TITLE PAGE:

Item (75) Inventors: Replace "Robert Wayne Spears, Ketchikan, KS (US)" with -- Robert Wayne Spears, Ketchikan, AK (US) --

Signed and Sealed this
Twenty-third Day of April, 2013

Teresa Stanek Rea
*Acting Director of the United States Patent and Trademark Office*